US005814755A

United States Patent [19]

Boss

[11] Patent Number: 5,814,755

[45] Date of Patent: Sep. 29, 1998

[54] METHOD FOR DETERMINING THE DISAGGREGATION TIME, IN PARTICULAR OF A PROGRAMMABLE PROJECTILE

[76] Inventor: André Boss, Allenmoosstrasse 138, Zürich, Switzerland, CH-8050

[21] Appl. No.: 749,325

[22] Filed: Nov. 14, 1996

[30] Foreign Application Priority Data

Apr. 19, 1996 [CH] Switzerland ..... 1996 1000/96

[51] Int. Cl.[6] ..... F42C 13/00

[52] U.S. Cl. ..... 89/6.5; 235/408

[58] Field of Search ..... 89/41.01, 41.22, 89/6.5, 6; 73/417; 102/489, 357, 211; 235/408, 404, 411, 417, 407; 434/24

[56] References Cited

U.S. PATENT DOCUMENTS

| | | | |
|---|---|---|---|
| 3,575,085 | 4/1971 | McAdam, Jr. | 89/41.01 |
| 4,142,442 | 3/1979 | Tuten | 89/6.5 |
| 4,267,776 | 5/1981 | Eickerman | 102/215 |
| 4,283,989 | 8/1981 | Toulios et al. | 8/6.5 |
| 4,449,041 | 5/1984 | Girard | 235/412 |
| 4,750,423 | 6/1988 | Nagabhushan | 89/1.51 |
| 4,955,279 | 9/1990 | Nahrwold | 89/6.5 |
| 4,957,046 | 9/1990 | Puttock | 102/489 |
| 4,960,055 | 10/1990 | Dieval | 102/489 |
| 5,140,329 | 8/1992 | Maughan et al. | 342/67 |
| 5,413,029 | 5/1995 | Gent et al. | 89/41.3 |
| 5,497,704 | 3/1996 | Kurschner et al. | 102/264 |

FOREIGN PATENT DOCUMENTS

| | | | |
|---|---|---|---|
| 0300255 | 1/1989 | European Pat. Off. . | |
| 0467055 | 1/1992 | European Pat. Off. . | |
| 3309147 | 9/1984 | Germany | 89/6.5 |
| 2107835 | 5/1983 | United Kingdom . | |

OTHER PUBLICATIONS

"AHEAD—Skyguard Fire Control/35 mm Twin Gun Air Defence System Demonstration"; Oerlikon–Contraves, Sep. 1993.

Rheinmetall publication, "Waffentechnisches Taschenbuch"; pp. 134, 208, 1980.

*Primary Examiner*—Charles Jordan

*Assistant Examiner*—Christopher K. Montgomery

[57] ABSTRACT

It is possible to improve the hit probability of programmable projectiles by means of this method. For this purpose a predetermined optimal disaggregation distance (Dz) between a disaggregation point (Pz) of the projectile (18) and an impact point (Pf) on the target is maintained constant by the correction of the disaggregation time (Tz) of the projectile (18). The correction is performed by adding a correcting factor, which is multiplied by a velocity difference, to the disaggregation time (Tz). The velocity difference is formed from the difference between the actually measured projectile velocity and a lead velocity of the projectile, wherein the lead velocity is calculated from the average value of a number of previous successive projectile velocities.

3 Claims, 3 Drawing Sheets

Figure 1:
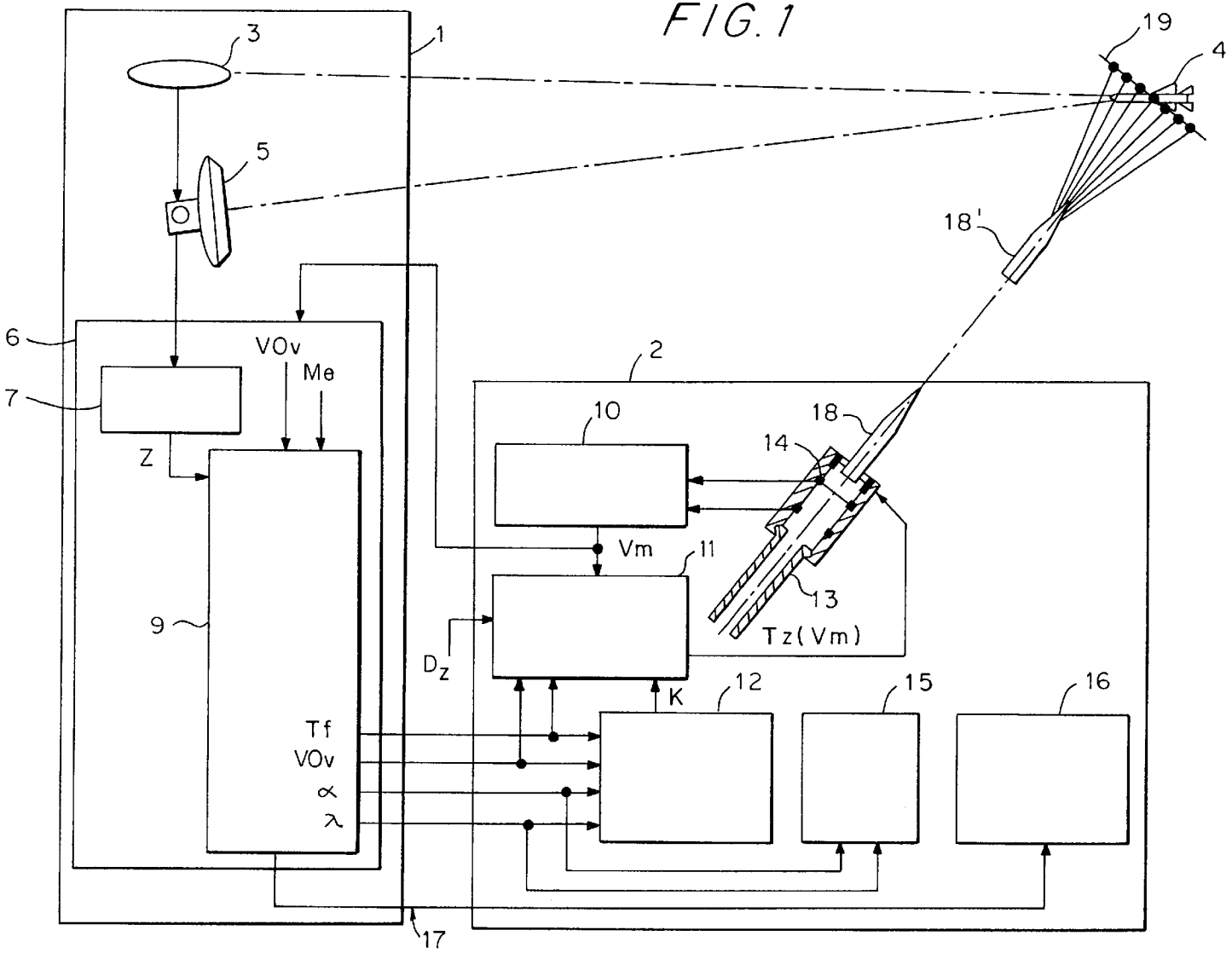

1
2
3
4
5
6
7
9
10
11
12
13
14
15
16
17
18
18'
19
Tz(Vm)
Vm
K
Dz
VOv
Me
Z
Tf
VOv
α
λ

METHOD FOR DETERMINING THE DISAGGREGATION TIME, IN PARTICULAR OF A PROGRAMMABLE PROJECTILE

The invention relates to a process for determining the disaggregation time of a programmable projectile, wherein the calculation is at least based on an impact distance to a target determined from sensor data, a projectile velocity measured at the muzzle of a gun barrel and a predetermined optimal disaggregation distance between an impact point and a disaggregation point of the projectile.

A device has become known from European patent application 0 300 255 which has a measuring device for the projectile velocity disposed at the muzzle of a gun barrel. The measuring device consists of two toroid coils arranged at a defined distance from each other. Because of the change of the magnetic flux created during the passage of a projectile through the two toroid coils, a pulse is generated in each toroid coil in rapid succession. The pulses are provided to an electronic evaluation device, in which the velocity of the projectile is calculated from the chronological distance between the pulses and the distance between the toroid coils. A transmitter coil for the velocity is disposed behind the measuring device in the direction of movement of the projectile, which acts together with a receiver coil provided in the projectile. The receiver coil is connected via a high pass filter with a counter, whose output side is connected with a time fuse. A disaggregation time is formed from the calculated velocity of the projectile and an impact distance to a target, which is inductively transmitted to the projectile directly after the passage through the measuring device. The time fuse is set by means of this disaggregation time, so that the projectile can be disaggregated in the area of the target.

If projectiles with sub-projectiles are employed (projectiles with primary and secondary ballistics) it is possible, for example as known from pamphlet OC 2052 d 94 of the Oerlikon-Contraves company of Zürich, to destroy an attacking target by multiple hits if, following the ejection of the sub-projectiles at the time of disaggregation, the expected area of the target is covered by a cloud constituted by the sub-projectiles. In the course of disaggregation of such a projectile the portion carrying the sub-projectiles is separated and ripped open at predetermined breaking points. The ejected sub-projectiles describe a spin-stabilized flight path caused by the rotation of the projectile and are located evenly distributed on approximately semicircular curves of circles of a cone, so that a good probability of an impact can be achieved.

It is not always possible with the above described device to achieve a good hit or shoot-down probability in every case because of dispersions in the disaggregation distance caused, for example, by fluctuations of the projectile velocity and/or use of non-actualized values. Although the circle would become larger with larger disaggregation distances, the density of the sub-projectiles would become less. The opposite case occurs with shorter disaggregation distances: the density of the sub-projectiles would be greater, but the circle smaller.

It is the object of the invention to propose a process and a device in accordance with the preamble, by means of which an optimum hit or shoot-down probability can be achieved, while avoiding the above mentioned disadvantages.

This object is attained by a defined optimal disaggregation distance between a disaggregation point of the projectile and an impact point on the target is maintained constant by correcting the disaggregation time. The correction is performed in that a correction factor multiplied by a velocity difference is added to the disaggregation time. The difference in the projectile velocity is formed from the difference between the actually measured projectile velocity and a lead velocity of the projectile, wherein the lead velocity of the projectile is calculated from the average value of a number of previous successive projectile velocities.

The advantages which can be achieved by means of the invention reside in that a defined disaggregation distance is independent of the actually measured projectile velocity, so that it is possible to achieve a continuous optimal hit or shoot-down probability. The correction factor proposed for the correction of the disaggregation time is merely based on the firing elements of the impact point in order to control the weapon, namely the gun angles $\alpha$, $\lambda$, the impact time Tf and the lead velocity VOv of the projectile. The possibility of a simple integration into already existing weapons control systems requiring a minimum outlay is provided with this.

Figure 2:
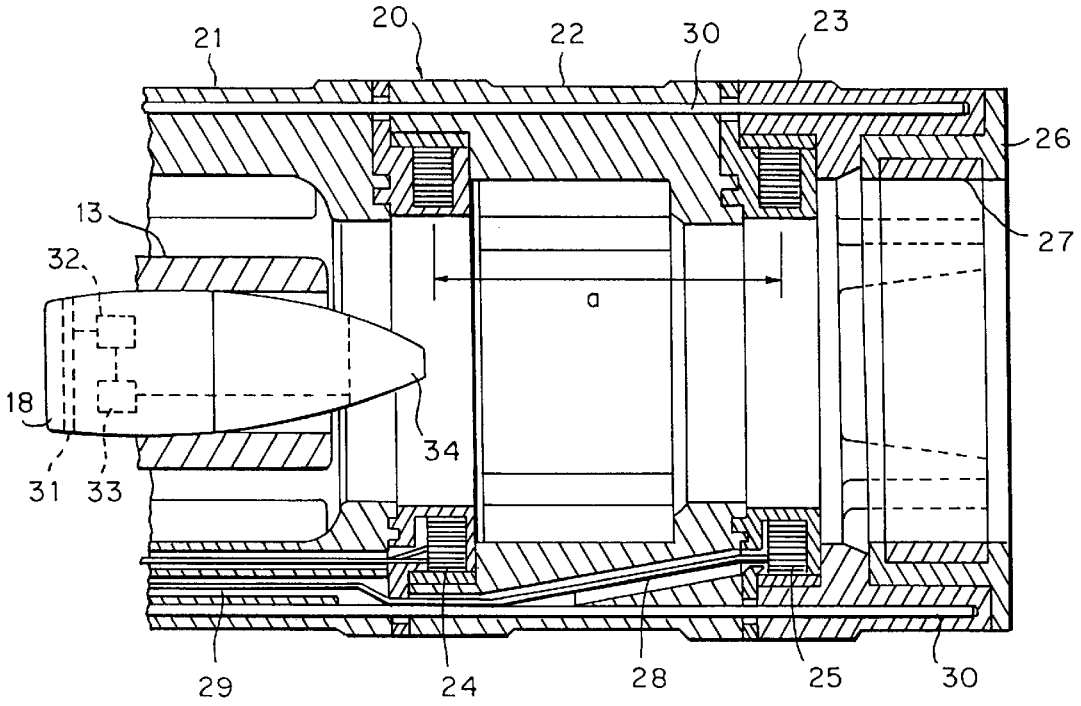
Figure 3:
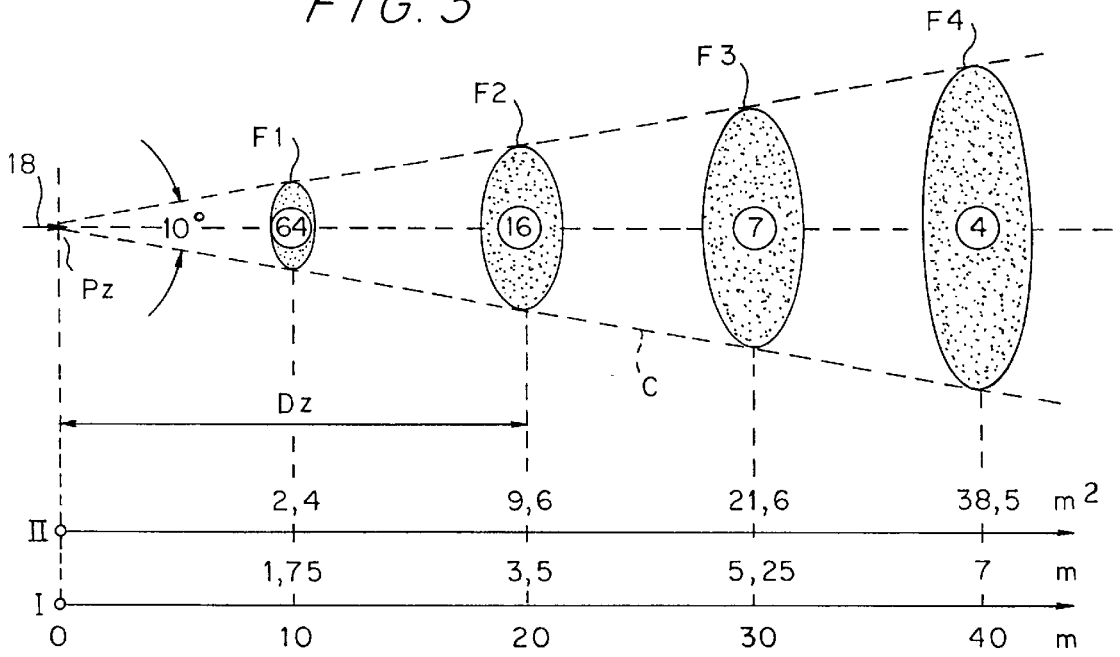
Figure 4:
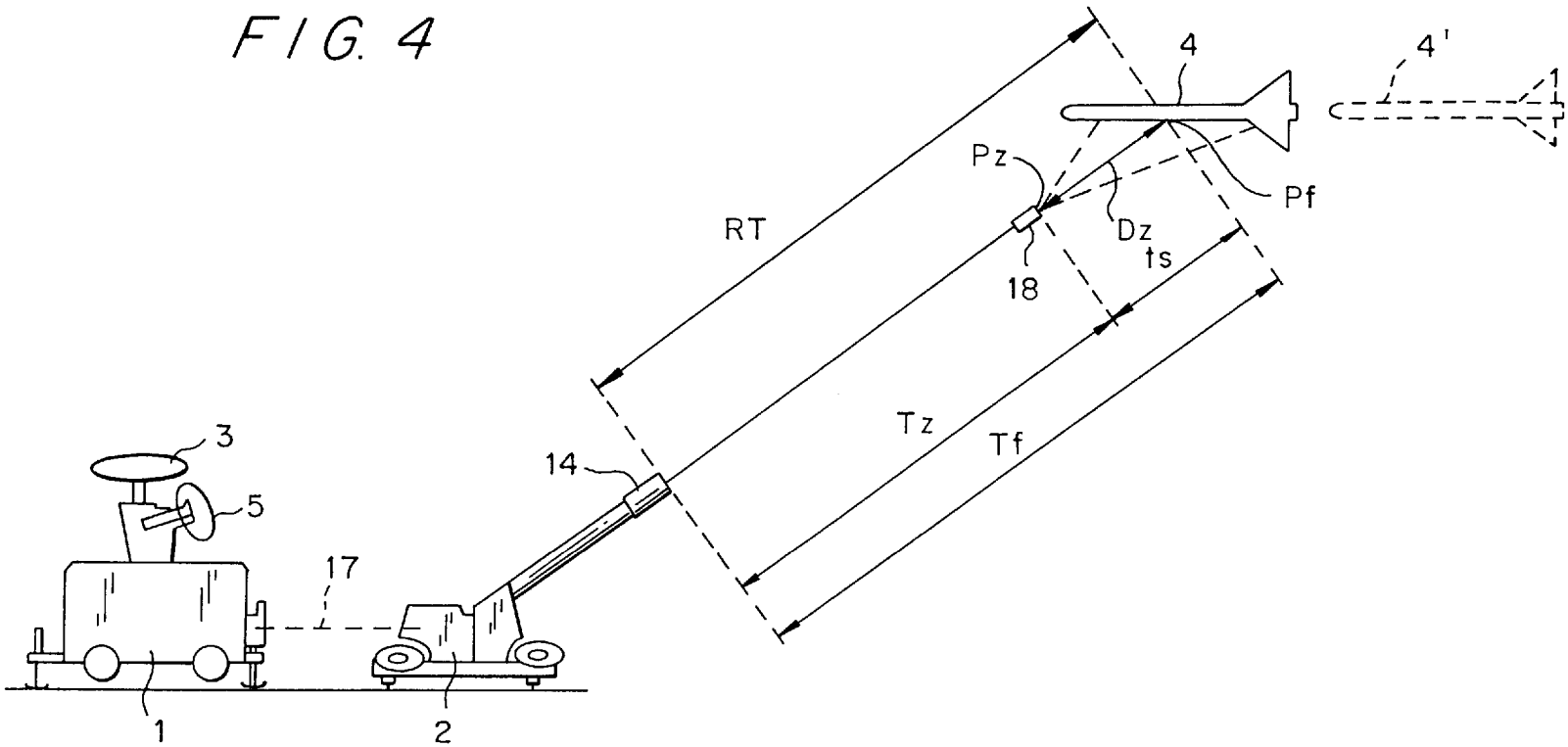

The invention will be explained in greater detail below by means of an exemplary embodiment in connection with the drawings. Shown are in:

FIG. 1 a schematic representation of a weapons control system with the device in accordance with the invention, FIG. 2 a longitudinal section through a measuring and programming device, FIG. 3 a diagram of the distribution of sub-projectiles as a function of the disaggregation distance, and FIG. 4 a different representation of the weapons control system in FIG. 1.

In FIG. 1, a firing control is indicated by 1 and a gun by 2. The firing control 1 consists of a search sensor 3 for detecting a target 4, a tracking sensor 5 for target detection connected with the search radar 3 for 3-D target following and 3-D target surveying, as well as a fire control computer 6. The fire control computer 6 has at least one main filter 7 and a lead computing unit 9. On the input side, the main filter 7 is connected with the tracking sensor 5 and on the output side with the lead computing unit 9, wherein the main filter 7 passes on the 3-D target data received from the tracking radar 5 in the form of estimated target data Z, such as position, velocity, acceleration, etc., to the lead computing unit 9. Meteorological data can be supplied to the lead computing unit 9 via a further input Me. The meaning of the identifiers at the individual junctions or connections will be explained in more detail below by means of the description of the functions.

A computer of the gun 2 has an evaluation circuit 10, an update computing unit 11 and a correction computing unit 12. On the input side, the evaluation circuit 10 is connected with a measuring device 14 for the projectile velocity disposed on the muzzle of a gun barrel 13, which will be described in greater detail below by means of FIG. 2, and on the output side with the lead computing unit 9 and the update computing unit 11. On the input side, the update computing unit 11 is connected with the lead and with the correction computing units 9, 12, and is connected on the output side with a programming element integrated into the measuring device 14. The correction computing unit 12 is connected on the input side with the lead computing unit 9, and on the output side with the update computing unit 11. A gun servo device 15 and a triggering device 16 reacting to the fire command are also connected with the lead computing unit 9. The connections between the fire control 1 and the gun 2 are combined into a data transmission device which is identified by 17. The meaning of the identifiers at the individual connections between the computing units 10, 11, 12 as well as between the fire control 1 and the gun 2 will be explained in greater detail below by means of the description of the functions. A projectile is identified by 18 and 18'and is represented in a programming phase (18) and at the time of disaggregation (18'). The projectile 18 is a programmable projectile with primary and secondary ballistics, which is equipped with an ejection load and a time fuse and filled with sub-projectiles 19.

In accordance with FIG. 2, a support tube 20 fastened on the muzzle of the gun barrel 13 consists of three parts 21, 22, 23. Toroid coils 24, 25 for measuring the projectile velocity are arranged between the first part 21 and second and third parts 22, 23. A transmitter coil 27, contained in a coil body 26, is fastened on the third part 23—also called a programming part. The manner of fastening of the support tube 20 and the three parts 21, 22, 23 with each other will not be further represented and described. Soft iron rods 30 are arranged on the circumference of the support tube 20 for the purpose of shielding against magnetic fields interfering with the measurements. The projectile 18 has a receiver coil 31, which is connected via a filter 32 and a counter 33 with a time fuse 34. During the passage of the projectile 18 through the toroid coils 24, 25, a pulse is generated in rapid succession in each toroid coil. The pulses are supplied to the evaluation circuit 10 (FIG. 1), in which the projectile velocity is calculated from the chronological distance between the pulses and a distance a between the toroid coils 24, 25. Taking the projectile velocity into consideration, a disaggregation time is calculated, as will be described in greater detail below, which is inductively transmitted in digital form during the passage of the projectile 18 by means of the transmitter coil 27 to the receiver coil 31 for the purpose of setting the counter 32.

A disaggregation point of the projectile 18 is indicated by Pz in FIG. 3. The ejected sub-projectiles are located, depending on the distance from the disaggregation point Pz, evenly distributed on approximately semicircular curves of (perspectively drawn) circular surfaces F1, F2, F3, F4 of a cone C. The distance from the disaggregation point Pz in meters m is plotted on a first abscissa 1, while the sizes of the surfaces F1, F2, F3, F4 are plotted in square meters $m^2$ and their diameters in meters m on a second abscissa II. With a characteristic projectile with, for example, 152 sub-projectiles, and a vertex angle of the cone C of initially 10°, the values plotted on the abscissa 11 result as a function of the distance. The density of the sub-projectiles located on the circular surfaces F1, F2, F3, F4 decreases with increasing distance and under the selected conditions is 64, 16, 7 and 4 sub-projectiles per square meter. With a predetermined disaggregation distance Dz of, for example 20 m, on which the calculation which follows has been based, a target area of the example used of 3.5 m diameter would be covered by 16 sub-projectiles per square meter.

The target to be defended against is identified by 4 and 4' in FIG. 4 and is represented in an impact and a launch position (4) and in a position (4') which precedes the impact or the launch position.

The above described device operates as follows:

The lead computing unit 9 calculates an impact distance RT from a lead velocity VOv and the target data Z of projectiles with primary and secondary ballistics, taking into consideration meteorological data.

For example, the lead velocity VOv is formed from the average values of a number of projectile velocities Vm supplied via the data transmission device 17, which have immediately preceded the actually measured projectile velocity Vm.

Based on a preset disaggregation distance Dz and taking into consideration the projectile velocity Vg(Tf), which is a function of an impact time Tf, it is possible to determine a disaggregation time Tz of the projectile in accordance with the following equations:

$$Dz=Vg(Tf)*ts \text{ and } Tz=Tf-ts$$

wherein Vg(Tf) is determined by ballistic approximation and Tz means the flight time of the projectile to the disaggregation point Pz and ts the flight time of a sub-projectile flying in the projectile direction from the disaggregation point Pz to the impact point Pf (FIGS. 3, 4).

The lead computing unit 9 furthermore detects a gun angle α of the azimuth and a gun angle λ of the elevation. The values α, λ, Tz or Tf and VOv are called the fire data elements of the impact point and are supplied via the data transmission device 17 to the correction computing unit 12. The shooting elements α and λ are supplied to the gun servo device 15 and the shooting elements VOv, Tf or Tz to the update computing unit 11.

The above described calculations are performed repeatedly in a clocked manner, so that the new data α, λ, Tz or Tf and VOv are available for a preset valid time in the respective actual clock period i.

Interpolation or extrapolation is respectively performed for the actual (current) time (t) between the clocked values.

At the start of each clock period i, the correction computing unit 12 calculates a correction factor K by means of the respectively latest set of fire data elements α, λ, Tz or Tf and VOv, for which purpose and as described in more detail below a conditional equation for the correction factor K will be developed.

In a definition of the correction factor K $$K := D_1\, t^*(v_0) = -\frac{\left\langle \vec{v}_{rel}(v_0), \frac{\partial \vec{p}_G}{\partial v_0} \right\rangle}{\langle \vec{v}_{rel}(v_0), \vec{v}_{rel}(v_0) \rangle} \qquad \text{Eq. 8}$$

$\vec{v}_{rel}$ is the relative velocity between the projectile and the target, and $(\partial \vec{p}G/\partial v_o)$ the derivative of the projectile position in accordance with the value of the initial velocity. Assuming straight ballistics, wherein the direction of the vector $\partial \vec{p}G/\partial v_o$ is approximately equal to the direction of the gun barrel 13, it is possible to set $$\frac{\partial \vec{p}_G}{\partial v_0} = \left\| \frac{\partial \vec{p}_G}{\partial v_0} \right\| \cdot \frac{\vec{v}_G(TG, \vec{Pos}_0, v_0)}{\|\vec{v}_G(TG, \vec{Pos}_0, v_0)\|} \qquad \text{Eq. 9}$$

In the process the value of the component of the initial lead velocity $v_o$ in the direction of the barrel is assumed to be constant. This means that $TG=TG(t_o)$ and $\vec{Pos}=\vec{Pos}(t_o)$ However, it should be noted that because of the movement of the gun barrel 13, $\vec{v}_o=\vec{v}_o(t_o)$ is still a function of time, which is expressed by the ballistic solution $$t \rightarrow \vec{p}_G(t, \vec{Pos}(t_o), \vec{v}_o(t_o)),\ t \rightarrow \vec{v}_G(t, \vec{Pos}(t_o), \vec{v}_o(t_o))$$

In this case the hit conditions are $$\vec{p}_G(TG(t_o), \vec{Pos}(t_o), \vec{v}_o(t_o)) = \vec{p}_z(t_o + TG(t_o)). \qquad \text{Eq. 10}$$

The derivative of the equation Eq. 10 in accordance with $t_o$ results in $$\vec{v}_Z(t_0+TG(t_0))=\frac{\frac{\partial TG}{\partial t_0}(t_0)}{1+\frac{\partial TG}{\partial t_0}(t_0)}\cdot\vec{v}_G(TG(t_0),\vec{Pos}(t_0),\vec{v}_0(t_0))+\vec{C},\qquad\text{Eq. 11}$$

which represents a splitting of the target speed into the projectile speed and a vector $\vec{C}$, wherein $$\left(1+\frac{\partial TG}{\partial t_0}(t_0)\right)\cdot\vec{C}=\qquad\text{Eq. 11.1}$$

$$D_2\,\vec{p}_G(TG(t_0);\vec{Pos}(t_0),\vec{v}_0(t_0))\cdot\frac{\partial\vec{Pos}}{\partial t_0}(t_0)+$$

$$D_3\,\vec{p}_G(TG(t_0),\vec{Pos}(t_0),\vec{v}_0(t_0))\cdot\frac{\partial\vec{v}_0}{\partial t_0}(t_0)$$

From general theory it is known that under the given premises the expression in equation Eq. 11.1 is $$D_2\,\vec{p}_G(TG(t_o),\vec{Pos}(t_o),\vec{v}_o(t_o))\approx Id$$

Furthermore, the barrel speed $\partial\vec{Pos}/\partial t_o(t_o)$ is low, so that the vector $$D_2\,\vec{p}_G(TG(t_0),\vec{Pos}(t_0),\vec{v}_0(t_0))\cdot\frac{\partial\vec{Pos}}{\partial t_0}(t_0)$$

in equation Eq. 11.1 can be considered to be negligibly small. In accordance with the general definition of the derivative, the following applies for $D_3$ in equation Eq. 11.1

$$D_3\,\vec{p}_G(TG(t_0),\vec{Pos}(t_0),\vec{v}_0(t_0))\cdot\frac{\partial\vec{v}_0}{\partial t_0}(t_0)=\qquad\text{Eq. 12}$$

$$\lim_{h\to 0}\frac{\vec{p}_G(TG(t_0),\vec{Pos}(t_0),\vec{v}_0(t_0+h))-\vec{p}_G(TG(t_0),\vec{Pos}(t_0),\vec{v}_0(t_0))}{h}.$$

If the elevation of the gun barrel 13 is neglected, $$\|\vec{p}_G(TG(t_0),\vec{Pos}(t_0),\vec{v}_0(t_0+h))-\vec{Pos}(t_0)\|=$$

$$\|\vec{p}_G(TG(t_0),\vec{Pos}(t_0),\vec{v}_0(t_0))-\vec{Pos}(t_0)\|,$$

so that the approximate result is $$\|\vec{p}_G(TG(t_o),\vec{Pos}(t_o),\vec{v}_o(t_o+h))\|=\|\vec{p}_G(TG(t_o),\vec{Pos}(t_o),\vec{v}_o(t_o))\|$$

Thus the point $\vec{p}_G(TG(t_o),\vec{Pos}(t_o),\vec{v}_o(t_o+h))$ therefore approximately moves on a circular path in a plane (plane of rotation), which is defined by the vectors $$\vec{p}_G(TG(t_o),\vec{Pos}(t_o),\vec{v}_o(t_{o+h}))$$

It is accordingly possible to write for the equation Eq. 12

$$D_3\,\vec{p}_G(TG(t_0),\vec{Pos}(t_0),\vec{v}_0(t_0))\cdot\frac{\partial\vec{v}_0}{\partial t_0}(t_0)=\vec{\omega}\times\vec{p}_G(TG(t_0),\vec{Pos}(t_0),\vec{v}_0(t_0))$$

wherein $\vec{\omega}$ is the vector of rotation perpendicularly to the plane of rotation. In this case it is assumed that the angular velocity of the gun barrel 13 around its instantaneous axis of rotation is equal in its amount to the angular velocity $\vec{p}_G(TG(t_o),\vec{Pos}(t_o),\vec{v}_o(t_o+h))$, so that the result is $$\omega:=\|\vec{\omega}\|=\frac{\|\vec{Pos}(t_0)\|}{\|\vec{Pos}(t_0)\|}=\sqrt{(\dot{\alpha}(t_0)\cdot\cos(\lambda(t_0)))^2+(\lambda(t_0))^2}\qquad\text{Eq. 13}$$

With the added assumption that in the case of straight ballistics the projectile velocity is approximately parallel with the target direction, i.e.

$$<(\vec{\omega}\times\vec{p}G(TG(t_o),\vec{Pos}(t_o),\vec{v}_o(t_o)),\vec{v}_G(TG(t_o),\vec{Pos}(t_o),\vec{v}_o(t_o))>=0\qquad\text{Eq. 14}$$

an equation Eq. 15 is derived from equation Eq. 11, which expresses the splitting of the target velocity into two orthogonal components:

$$\vec{v}_Z(t_o+TG(t_o))=\qquad\text{Eq. 15}$$

$$\frac{\frac{\partial TG}{\partial t_0}(t_0)}{1+\frac{\partial TG}{\partial t_0}(t_0)}\cdot\vec{v}_G(TG(t_0),\vec{Pos}(t_0),\vec{v}_0(t_0))+$$

$$\frac{1}{1+\frac{\partial TG}{\partial t_0}(t_0)}\cdot\vec{\omega}\times\vec{p}_G(TG(t_0),\vec{Pos}(t_0),\vec{v}_0(t_0)).$$

By inserting the equation Eq. 9 into the equation Eq. 8 and taking into consideration the definition of $\vec{v}_{rel}(v_o)$ $$\vec{v}_{rel}(v_m):=\vec{v}_G(t^*(v_m),\vec{Pos}_o,v_m)-\vec{v}_Z(t_o+t^*(v_m))$$

and the definitions $$p_G:=\|\vec{p}_G(TG(t_o),\vec{Pos}(t_o),\vec{v}_o(t_o))\|$$

$$v_G:=\|\vec{v}_G(TG(t_o),\vec{Pos}(t_o),\vec{v}_o(t_o))\|$$

$$v_z:=\|\vec{v}_z(t_{+TG}(t_o))\|$$

the result is $$K=-\frac{v_G^2-<\vec{v}_G(TG(t_0),\vec{Pos}(t_0),\vec{v}_0(t_0)),\vec{v}_Z(t_0+TG(t_0))>}{\vec{v}_G^2-2<\vec{v}_G(TG(t_0),\vec{Pos}(t_0),\vec{v}_0(t_0)),\vec{v}_Z(t_0+TG(t_0))>+v_Z^2}\cdot\frac{\left\|\frac{\partial\vec{p}_G}{\partial v_0}\right\|}{v_G}.$$

Taking into consideration the definitions for $p_G$, $v_G$ and $v_2$ $$<\vec{v}_G(TG(t_0),\vec{Pos}(t_0),\vec{v}_0(t_0)),\vec{v}_Z(t_0+TG(t_0))>=\frac{\frac{\partial TG}{\partial t_0}(t_0)}{1+\frac{\partial TG}{\partial t_0}(t_0)}\cdot v_G^2,$$

and $$v_Z^2=\left(\frac{\frac{\partial TG}{\partial t_0}(t_0)}{1+\frac{\partial TG}{\partial t_0}(t_0)}\right)^2\cdot v_G^2+\frac{\omega^2+p_G^2}{\left(1+\frac{\partial TG}{\partial t_0}(t_0)\right)^2},$$

it follows from the equations Eq. 14 and Eq. 15 that $$K = -\frac{v_G^2 \cdot \left(1 - \frac{\frac{\partial TG}{\partial t_0}(t_0)}{1 + \frac{\partial TG}{\partial t_0}(t_0)}\right)}{v_G^2 \cdot \left(1 - \frac{\frac{\partial TG}{\partial t_0}(t_0)}{1 + \frac{\partial TG}{\partial t_0}(t_0)}\right)^2 + \frac{\omega^2 \cdot p_G^2}{\left(1 + \frac{\partial TG}{\partial t_0}(t_0)\right)^2}} \cdot \frac{\left\|\frac{\partial \vec{p}_G}{\partial v_0}\right\|}{v_G} = -\frac{v_G^2 \cdot \frac{1}{1 + \frac{\partial TG}{\partial t_0}(t_0)}}{v_G^2 \cdot \left(\frac{1}{1 + \frac{\partial TG}{\partial t_0}(t_0)}\right)^2 + \omega^2 \cdot p_G^2 \cdot \left(\frac{1}{1 + \frac{\partial TG}{\partial t_0}(t_0)}\right)^2} \cdot \frac{\left\|\frac{\partial \vec{p}_G}{\partial v_0}\right\|}{v_G} \quad \text{Eq. 16}$$

The equation Eq. 16 is simplified by reducing with $$\frac{v_G^2}{\left(1 + \frac{\partial TG}{\partial t_0}(t_0)\right)^2},$$

from which the correction factor K $$K = -\frac{1 + \frac{\partial TG}{\partial t_0}(t_0)}{1 + \frac{p_G^2}{v_G^2} \cdot \omega^2} \cdot \frac{\left\|\frac{\partial \vec{p}_G}{\partial v_0}\right\|}{v_G} \quad \text{Eq. 17}$$

results. In equation Eq. 17 it is possible to calculate the derivative of the flying time $$\frac{\partial TG}{\partial t_o}(t_o)$$

by means of the fire control 1 by means of different mathematical methods. In accordance with equation Eq. 13, $\omega^2$ is a known function of $\dot{\alpha}(t_o)$,$\lambda(t_o)$ and $\dot{\lambda}(t_o)$. These values can either be calculated or measured directly at the gun 2.

The values $$\frac{p_G^2}{v_G^2} \text{ and } \frac{\left\|\frac{\partial \vec{p}_G}{\partial v_o}\right\|}{v_G}$$

are given by ballistics. They are first order functions of the flying time and in the second order of the barrel elevation, which can be negligible. It is possible, for example, to apply a solution in accordance with d'Antonio for determining these values. This formulation supplies $$\frac{p_G}{v_G} = TG(t_o) \cdot \left(1 + \frac{1}{2} \cdot q \cdot \sqrt{\|\vec{v}_o(t_o)\| \, \|\vec{v}_n\|} \cdot TG(t_o)\right) \quad \text{Eq. 18}$$

-continued $$\frac{\left\|\frac{\partial \vec{p}_G}{\partial v_o}\right\|}{v_G} = \frac{TG(t_o) \cdot \left(1 + \frac{1}{4} \cdot q \cdot \sqrt{\|\vec{v}_o(t_o)\| \, \|\vec{v}_n\|} \cdot TG(t_o)\right)}{\|\vec{v}_o(t_o)\|}, \quad \text{Eq. 19}$$

wherein $$q := c_w \cdot \frac{\text{air density} \cdot \text{projectile cross section}}{2 \cdot \text{projectile mass}}$$

wherein q:=$C_w$ air density·projectile cross section/2.projectile mass where "cross section" refers to transverse cross section and $\vec{v}_n$ means a velocity (nominal initial velocity of the projectile), which relates to the $C_w$ value. By inserting the equations Eq. 18 and Eq. 19 into equation Eq. 17, the correction factor K becomes $$K = -\frac{\left(1 + \frac{\partial TG}{\partial t_o}\right) \cdot TG \cdot \left(1 + \frac{1}{4} \cdot q \cdot \sqrt{\|\vec{v}_o\| \, \|\vec{v}_n\|} \cdot TG\right)}{1 + \left(TG \cdot \left(1 + \frac{1}{2} \cdot q \cdot \sqrt{\|\vec{v}_o\| \, \|\vec{v}_n\|} \cdot TG\right)\right)^2 \cdot ((\dot{\alpha} \cdot \cos(\lambda))^2 + (\dot{\lambda})^2) \cdot v_G},$$

wherein the values $$TG, \frac{\partial TG}{\partial t_o}, \alpha, \lambda, \dot{\alpha}, \dot{\lambda}$$

and $\vec{v}_o$ relate to the time $t_o$.

The mathematical or physical notation used above means:

$\vec{v}$ a vector $\|\vec{v}\|$ the standard of a vector $(\vec{u}, \vec{v})$ scalar product $\vec{u} \times \vec{v}$ vector product Id uniform matrix scalar or matrix multiplication g :=A. the value g is defined as the expression A $g=g(x_1, \ldots, x_n)$ the value g depends on $x_1, \ldots, x_n$ $t \rightarrow g(t)$ assignment (the evaluation of g at point t is assigned to t)

$\dot{g}$ derivative of g in accordance with time $D_i g(x_1, \ldots, x_n)$ partial derivative of g after the i-th variable $\partial/\partial t\, g(t, x_1, \ldots, x_n)$ partial derivative of g after the time t $\lim_{h \rightarrow O} A(h)$ limit of the expression A for h toward U $\inf_t M$ lower limit of the amount M over all t $\vec{p}_G$, $\vec{v}_G$, $\vec{a}_G$ position, velocity, acceleration of the projectile $\vec{p}_z$, $\vec{v}_z$, $\vec{a}_z$ position, velocity, acceleration of the target $\vec{p}_{rel}$, $\vec{v}_{rel}$, $\vec{a}_{rel}$ relative position, velocity, acceleration projectile-target $\vec{P}o$ s position of the mouth of the barrel $\alpha\lambda$ azimuth and elevation of the gun barrel $\vec{v}_o$ initial lead velocity of the projectile $\vec{v}_o$ amount of the component of the initial lead velocity of the projectile in the barrel direction $v_m$ amount of the component of the effective initial speed of the projectile in the barrel direction TG lead flying time of the projectile t* flying time of the projectile $t_o$ time at which the projectile passes the mouth of the barrel From the correction factor K supplied by the correction computing unit 12, the actually measured projectile speed Vm supplied by the evaluation circuit 10 and from the lead velocity Vov and disaggregation time Tz supplied by the lead computing unit 9, the update computing unit 11 calculates a corrected disaggregation time Tz(Vm) in accordance with the equation $$Tz(Vm)=Tz+K^*(Vm-VOv)$$

The corrected disaggregation time Tz(Vm) is interpolated or extrapolated for the actual current time t depending on the valid time. The freshly calculated disaggregation time Tz(Vm, t) is provided to the transmitter coil 27 of the programming unit 23 of the measuring device 14 and is inductively transmitted to a passing projectile 18 as already previously described in connection with FIG. 2.

It is possible to maintain the disaggregation distance Dz (FIGS. 3, 4) constant independently of the fluctuation of the projectile velocity by means of the correction of the disaggregation time Tz, so that it is possible to achieve an optimal hit or shoot-down probability.

Assuming straight ballistics, it is possible to put $$\frac{\partial \vec{p}_G}{\partial v_o} = \left\| \frac{\partial \vec{p}_G}{\partial v_o} \right\| \cdot \frac{\vec{Pos}(t_o)}{\|\vec{Pos}(t_o)\|}$$

in place of the equation eq. 9, wherein this formulation in the first order leads to the same result for the correction factor k when taking the fall angles for short ballistics into account.

I claim:

1. A process for determining a fuze time for disaggregation of a programmable projectile (18) shot from a gun barrel (13) toward a target, the process comprising:

measuring a projectile measured muzzle velocity (Vm)

determining, from target sensor data, an impact distance (RT) from the gun barrel to the target;

subtracting a predetermined disaggregation distance (Dz) from the impact distance, the predetermined disaggregation distance being a difference between an impact point (Pf) and a disaggregation point (Pz) of the projectile;

calculating as a function of the measured muzzle velocity a corrected disaggregation time Tz(Vm) according to $$Tz(Vm)=Tz+K^*(Vm-VOv)$$

where Vov is a projectile average muzzle velocity, Tz is a nominal disaggregation time corresponding to the projectile average muzzle velocity, and K is a correction factor;

and wherein the correction factor K is given by $$K = -\frac{1+(\partial TG/\partial t)|_{t=t_o}}{1+(p^2_G/v^2_G)\cdot\omega^2} \cdot \frac{\|(\partial p_G/\partial v_o)\|}{V_G} \qquad \text{(Eq. 17)}$$

2. The process in accordance with claim 1, wherein the correction factor (K) is calculated starting from a definition $$K = D_1 t^*(v_o) = -\frac{\langle \vec{v}_{rel}(v_o), \frac{\partial \vec{p}_G}{\partial v_o} \rangle}{\langle \vec{v}_{rel}(v_o), \vec{v}_{rel}(v_o) \rangle} \qquad \text{Eq. 8}$$

and a derivative of the projectile position in accordance with the amount of the initial velocity, and assuming straight ballistics, $$\frac{\partial \vec{p}_G}{\partial v_o} = \left\| \frac{\partial \vec{p}_G}{\partial v_o} \right\| \cdot \frac{\vec{v}_G(TG, \vec{Pos}_o, v_o)}{\|\vec{v}_G(TG, \vec{Pos}_o, v_o)\|} \qquad \text{Eq. 9}$$

as well as a ballistic solution $$t \to \vec{p}_G(t, \vec{Pos}(t_o), \vec{v}_o(t_o)),\ t \to \vec{v}_G(t, \vec{Pos}(t_o), \vec{v}_o(t_o))$$

and a hit condition $$\vec{p}hd\ G(TG(t_o), \vec{Pos}(t_o), \vec{v}_o(t_o)) = \vec{p}_Z(t_o + TG(t_o)), \qquad \text{Eq. 10}$$

wherein the correction factor (K) is brought into a relationship with a flying time (TG) of the projectile, gun angles $\alpha$, $\lambda$ and the lead velocity, differentiating of the equation Eq. 10 after the time $t_o$ provides $$\vec{v}_Z(t_o + TG(t_o)) = \frac{\frac{\partial TG}{\partial t_o}(t_o)}{1+\frac{\partial TG}{\partial t_o}(t_o)} \cdot \vec{v}_G(TG(t_o), \vec{Pos}(t_o), \vec{v}_o(t_o)) + \vec{C} \qquad \text{Eq. 11}$$

wherein the equation Eq. 11 represents a split of the target velocity into the projectile velocity and a vector $\vec{C}$, and wherein $$\left(1+\frac{\partial TG}{\partial t_o}(t_o)\right)\cdot\vec{C} = D_2\vec{p}_G(TG(t_o), \vec{Pos}(t_o), \vec{v}_o(t_o)) \cdot \frac{\partial \vec{Pos}}{\partial t_o}(t_o) + D_3\vec{p}_G(TG(t_o), \vec{Pos}(t_o), \vec{v}_o(t_o)) \cdot \frac{\partial \vec{v}_0}{\partial t_o}(t_o) \qquad \text{Eq. 11.1}$$

neglecting the expression $$D_2\vec{p}_G(TG(t_o), \vec{Pos}(t_o), \vec{v}_o(t_o)) \cdot \frac{\partial \vec{Pos}}{\partial t_o}(t_o)$$

in equation Eq. 11.1, defining the derivative $D_3$ in equation Eq. 11.1

$$D_3\vec{p}_G(TG(t_o), \vec{Pos}(t_o), \vec{v}_o(t_o)) \cdot \frac{\partial \vec{v}_o}{\partial t_o}(t_o) = \lim_{h\to 0} \frac{\vec{p}_G(TG(t_o), \vec{Pos}(t_o), \vec{v}_o(t_o+h)) - \vec{p}_G(TG(t_o), \vec{Pos}(t_o), \vec{v}_o(t_o))}{h} \qquad \text{Eq. 12}$$

neglecting elevation of the gun barrel (13), wherein $$\|\vec{p}_G(TG(t_o), \vec{Pos}(t_o), \vec{v}_o(t_o+h)) - \vec{Pos}(t_o)\| = \|\vec{p}_G(TG(t_o), \vec{Pos}(t_o), \vec{v}_o(t_o)) - \vec{Pos}(t_o)\|$$

and $$\|\vec{p}_G(TG(t_o), \vec{Pos}(t_o), \vec{v}_o(t_o+h))\| = \|\vec{p}_G(TG(t_o), \vec{Pos}(t_o), \vec{v}_o(t_o))\|$$

approximately results, so that the equation Eq. 12 can be written as $$D_3\vec{p}_G(TG(t_o), \vec{Pos}(t_o), \vec{v}_o(t_o)) \cdot \frac{\partial \vec{v}_o}{\partial t_o}(t_o) = \vec{\omega} \times \vec{p}_G(TG(t_o), \vec{Pos}(t_o), \vec{v}_o(t_o))$$

wherein $\vec{\omega}$ is a vector of rotation perpendicularly in respect to a plane of rotation, assuming that an amount of the angular velocity of the gun barrel (13) around an instantaneous axis of rotation there of is equal to the angular velocity of $\vec{p}_G(TG(t_o), \vec{Pos}(t_o), \vec{v}_o(t_o+h))$ so that ω is defined as $$\omega = \|\vec{\omega}\| = \frac{\|\dot{\vec{Pos}}(t_o)\|}{\|\vec{Pos}(t_o)\|} = \sqrt{(\dot{\alpha}(t_o) \cdot \cos(\lambda(t_o)))^2 + (\dot{\lambda}(t_o))^2} \quad \text{Eq. 13}$$

results, assuming that with straight ballistics the projectile velocity is approximately parallel with the target direction such that $$(\vec{\omega} \times \vec{p}_G(TG(t_o), \vec{Pos}(t_o), \vec{v}_o(t_o)), \vec{v}_G(TG(t_o), \vec{Pos}(t_o), \vec{v}_o(t_o))) = 0 \quad \text{Eq. 14}$$

and that an equation Eq. 11, which expresses the splitting of the target speed into two orthogonal components $$\vec{v}_Z(t_o + TG(t_o)) = \frac{\frac{\partial TG}{\partial t_o}(t_o)}{1 + \frac{\partial TG}{\partial t_o}(t_o)} \cdot \vec{v}_G(TG(t_o), \vec{Pos}(t_o), \vec{v}_o(t_o)) + \frac{1}{1 + \frac{\partial TG}{\partial t_o}(t_o)} \cdot \vec{\omega} \times \vec{p}_G(TG(t_o), \vec{Pos}(t_o), \vec{v}_o(t_o)) \quad \text{Eq. 15}$$

wherein inserting equation Eq. 9 into equation Eq. 8, taking into consideration the definition of $$\vec{v}_{rel}(\vec{v}_m) = \vec{v}_G(t^*(v_m), \vec{Pos}_o, v_m) - \vec{v}_Z(t_o + t^*(v_m))$$

and the definitions $$p_G = \|\vec{p}_G(TG(t_o), \vec{Pos}(t_o), \vec{v}_o(t_o))\|$$

$$v_G = \|\vec{v}_G(TG(t_o), \vec{Pos}(t_o), \vec{v}_o(t_o))\|$$

$$v_z = \|\vec{v}_Z(t_o + TG(t_o))\|$$

results in $$K = -\frac{v_G^2 - \langle \vec{v}_G(TG(t_0), \vec{Pos}(t_0), \vec{v}_0(t_0)), \vec{v}_Z(t_0 + TG(t_0)) \rangle}{v_G^2 - 2\langle \vec{v}_G(TG(t_0), \vec{Pos}(t_0), \vec{v}_0(t_0)), \vec{v}_Z(t_0 + TG(t_0)) \rangle + v_Z^2} \cdot \frac{\left\| \frac{\partial \vec{p}_G}{\partial v_0} \right\|}{v_G}$$

and taking into consideration the definitions of $p_G$, $v_G$ and $v_z$ results in $$\langle \vec{v}_G(TG(t_0), \vec{Pos}(t_0), \vec{v}_0(t_0)), \vec{v}_z(t_0 + TG(t_0)) \rangle = \frac{\frac{\partial TG}{\partial t_0}(t_0)}{1 + \frac{\partial TG}{\partial t_0}(t_0)} \cdot v_G^2$$

from equations Eq. 14 and Eq. 15, as well as $$v_Z^2 = \left( \frac{\frac{\partial TG}{\partial t_0}(t_0)}{1 + \frac{\partial TG}{\partial t_0}(t_0)} \right)^2 \cdot v_G^2 + \frac{\omega^2 \cdot p_G^2}{\left(1 + \frac{\partial TG}{\partial t_0}(t_0)\right)^2}$$

so that $$K = -\frac{v_G^2 \cdot \left(1 - \frac{\frac{\partial TG}{\partial t_0}(t_0)}{1 + \frac{\partial TG}{\partial t_0}(t_0)}\right)^2}{v_G^2 \cdot \left(1 - \frac{\frac{\partial TG}{\partial t_0}(t_0)}{1 + \frac{\partial TG}{\partial t_0}(t_0)}\right)^2 + \frac{\omega^2 \cdot p_G^2}{\left(1 + \frac{\partial TG}{\partial t_0}(t_0)\right)^2}} \cdot \frac{\left\| \frac{\partial \vec{p}_G}{\partial v_0} \right\|}{v_G} = -\frac{v_G^2 \cdot \frac{1}{1 + \frac{\partial TG}{\partial t_0}(t_0)}}{v_G^2 \cdot \left(\frac{1}{1 + \frac{\partial TG}{\partial t_0}(t_0)}\right)^2 + \omega^2 \cdot p_G^2 \cdot \left(\frac{1}{1 + \frac{\partial TG}{\partial t_0}(t_0)}\right)^2} \cdot \frac{\left\| \frac{\partial \vec{p}_G}{\partial v_0} \right\|}{v_G} \quad \text{Eq. 16}$$

so that, reducing equation Eq. 16 by $$\frac{v_G^2}{\left(1 + \frac{\partial TG}{\partial t_0}(t_0)\right)^2},$$

the correction factor (K) becomes $$K = -\left. \frac{1 + \frac{\partial TG}{\partial t_0}(t)}{1 + \frac{p_G^2}{v_G^2} \cdot \omega^2} \right|_{t=t_0} \cdot \frac{\left\| \frac{\partial \vec{p}_G}{\partial v_0} \right\|}{v_G}$$

wherein, the following meanings apply $\vec{p}_G$, $\vec{v}_G$, $\vec{a}_G$ position, velocity, acceleration of the projectile $\vec{p}_Z$, $\vec{u}_Z$, $\vec{a}_Z$ position, velocity, acceleration of the target $\vec{p}_{rel}$, $\vec{v}_{rel}$, $\vec{a}_{rel}$ relative position, velocity, acceleration projectile-target $\vec{Pos}$ position of the mouth of the barrel αλ azimuth and elevation of the gun barrel $\vec{v}_o$ initial lead velocity of the projectile $v_o$ amount of the component of the initial lead velocity of the projectile in the barrel direction $v_m$ amount of the component of the effective initial speed of the projectile in the barrel direction TG lead flying time of the projectile t* flying time of the projectile $t_o$time at which the projectile passes the mouth of the barrel.

3. The method in accordance with claim 1, wherein the values $$\frac{p_G^2}{v_G^2} \quad \text{and} \quad \frac{\left\| \frac{\partial \vec{p}_G}{\partial v_0} \right\|}{v_G}$$

of equation Eq. 17 are determined in accordance with equations $$\frac{p_G}{v_G} = TG(t_0) \cdot \left( 1 + \frac{1}{2} \cdot k \cdot \sqrt{\|\vec{v}_0(t_0)\| \, \|\vec{v}_n\|} \cdot TG(t_0) \right) \quad \text{Eq. 18}$$

$$\frac{\left\| \frac{\partial \vec{p}_G}{\partial v_0} \right\|}{v_G} = \frac{TG(t_0) \cdot \left( 1 + \frac{1}{4} \cdot k \cdot \sqrt{\|\vec{v}_0(t_0)\| \, \|\vec{v}_n\|} \cdot TG(t_0) \right)}{\|\vec{v}_0(t_0)\|} \quad \text{Eq. 19}$$

wherein q is defined by $$q = C_w \cdot \frac{\text{air density} \cdot \text{projectile cross section}}{2 \cdot \text{projectile mass}}$$

and $\vec{v}_n$ is a projectile velocity, related to the $C_w$ value, and that the equations Eq. 18 and Eq. 19 are inserted into equation Eq. 17, wherein the result is $$\begin{aligned} K &= K\left( TG, \frac{\partial TG}{\partial t_0}, \alpha, \lambda, \dot{\alpha}, \dot{\lambda}, v_0 \right) \\ &= -\frac{\left( 1 + \frac{\partial TG}{\partial t_0} \right) \cdot TG \cdot \left( 1 + \frac{1}{4} \cdot k \cdot \sqrt{\|\vec{v}_0\| \, \|\vec{v}_n\|} \cdot TG \right)}{1 + \left( TG \cdot \left( 1 + \frac{1}{2} \cdot k \cdot \sqrt{\|\vec{v}_0\| \, \|\vec{v}_n\|} \cdot TG \right) \right)^2 \cdot ((\dot{\alpha} \cdot \cos(\lambda))^2 + (\dot{\lambda})^2) \cdot v_G} . \end{aligned}$$

* * * * *

UNITED STATES PATENT AND TRADEMARK OFFICE

CERTIFICATE OF CORRECTION

PATENT NO. : 5,814,755

DATED : Sep. 29, 1998

INVENTOR(S) : Andre Boss

It is certified that error appears in the above-identified patent and that said Letters Patent is hereby corrected as shown below:

Cover page, after line [76], insert the following:

--[73] Assignee: OERLIKON CONTRAVES AG

Zurich, Switzerland--

Cover page, before [57] ABSTRACT, insert the following:

-- Attorney, Agent, or Firm: Browdy and Neimark --

Signed and Sealed this

Fifth Day of January, 1999

*Attest:*

*Attesting Officer*

*Acting Commissioner of Patents and Trademarks*